US005992356A

United States Patent [19]

Howell-Smith

[11] Patent Number: 5,992,356

[45] Date of Patent: Nov. 30, 1999

[54] OPPOSED PISTON COMBUSTION ENGINE

[75] Inventor: Bradely David Howell-Smith, Worongary, Australia

[73] Assignee: Revolution Engine Technologies Pty Ltd, Queensland, Australia

[21] Appl. No.: 09/000,099

[22] PCT Filed: Jul. 17, 1996

[86] PCT No.: PCT/AU96/00449

§ 371 Date: Jan. 20, 1998

§ 102(e) Date: Jan. 20, 1998

[87] PCT Pub. No.: WO97/04225

PCT Pub. Date: Feb. 6, 1997

[30] Foreign Application Priority Data

Jul. 18, 1995 [AU] Australia ..... PN 4206
Oct. 30, 1995 [AU] Australia ..... PN 6258

[51] Int. Cl.[6] ..... F02B 75/24

[52] U.S. Cl. ..... 123/55.3

[58] Field of Search ..... 123/55.3, 53.3, 123/53.4

[56] References Cited

U.S. PATENT DOCUMENTS 4,679,552 10/1987 Kolev ..... 123/55.3
4,848,282 7/1989 Chaneac ..... 123/55.3
5,402,755 4/1995 Waissi ..... 123/55.3
5,634,441 6/1997 Ragain ..... 123/55.3

*Primary Examiner*—Marguerite McMahon
*Attorney, Agent, or Firm*—Knobbe Martens Olson & Bear LLP

[57] ABSTRACT

An engine comprises two counter rotating multilobate cams which are acted upon by a pair of diametrically opposed pistons which are rigidly interlinked by connecting rods. Differential gearing is provided to time the counter rotation of the cams.

The following is an examiner's statement of reasons for allowance: The prior art fails to teach or fairly suggest the invention as a whole including a shaft having a first multilobate cam axially fixed to said shaft and an adjacent second multilobate cam differentially geared to said first multilobate cam for axial counter rotation about said shaft, at least one pair of cylinders, the cylinders of each pair being diametrically opposed with respect to said shaft with said multilobate cams interposed therebetween, and a piston in each said cylinder, said pistons of a pair of cylinders being rigidly interconnected.

14 Claims, 5 Drawing Sheets

OPPOSED PISTON COMBUSTION ENGINE

TECHNICAL FIELD

This invention relates to internal combustion engines. In particular, the invention relates to internal combustion engines with improved control over the various cycles of the engine's operation. The invention also relates to internal combustion engines with improved torque characteristics.

BACKGROUND ART

Internal combustion engines such as used in automobiles are typically of the reciprocating type in which a piston oscillating in a cylinder drives a crankshaft via a connecting rod. There are numerous disadvantages in conventional reciprocating engine design, which disadvantages in large stem from the reciprocating motion of the piston and connecting rod.

Many engine designs have been developed to overcome the limitations and disadvantages of conventional internal combustion engines of the reciprocating type. These developments include rotary engines, such the wellknown Wankel engine, and engines in which a cam or cams are used in place of at least the crankshaft and, in some cases, connecting rods as well.

Internal combustion engines of the type where a cam or cams replace the crankshaft are described, for example, in U.S. Pat. No. 4,848,282 and Australian Patent Application No. 17897/76. However, while developments in this type of engine have allowed some of the disadvantages of conventional reciprocating-type engines to be overcome, engines using a cam or cams in place of a crankshaft have not been fully exploited.

It is also known to provide internal combustion engines having opposed, interconnected pistons. Such an arrangement is described in Australian Patent Application No. 36206/84. However, there is no suggestion in this disclosure, and like disclosures, that the concept of opposed interconnected pistons can be used in conjunction with anything other than a crankshaft.

SUMMARY OF THE INVENTION

It is an object of the present invention to provide an internal combustion engine of the camming rotary type which may have improved torque and engine cycle control characteristics. It is also an object of the present invention to provide an internal combustion engine which may overcome at least some of the disadvantages of existing internal combustion engines.

According to a broad format, this invention provides an internal combustion engine comprising at least one cylinder module, said cylinder module comprising:

- a shaft having a first multilobate cam axially fixed to said shaft and an adjacent second multilobate cam differentially geared to said first multilobate cam for axial counter rotation about said shaft;
- at least one pair of cylinders, the cylinders of each which pair are diametrically opposed with respect to said shaft with said multilobate cams interposed therebetween: and
- a piston in each said cylinder, which pistons of a pair of cylinders are rigidly interconnected;
- wherein, said multilobate cams each comprise 3+n lobes where n is zero or an even-numbered integer;
- and wherein, reciprocating motion of said pistons in said cylinders imparts rotary motion to said shaft via contact between said pistons and the camming surfaces of said multilobate cams.

It will be appreciated from the foregoing passage that the crankshaft and connecting rods of a conventional internal combustion engine are replaced by a linear shaft and multilobate cams in an engine according to the invention. Use of a cam in the place of a connecting rod/crankshaft arrangement allows greater control over the positioning of a piston throughout the cycling of the engine. For example, the period at which a piston is at top-dead-center (TDC) can be extended.

It will be further appreciated from the broad description of the invention that although two cylinders are provided in the at least one pair of cylinders, a double-acting piston-cylinder arrangement is in effect provided by the opposed cylinders with interconnected pistons. The rigid interconnection of pistons also eliminates torsional twisting and minimizes piston to cylinder wall contact thereby reducing friction.

The use of the two counter-rotating cams allows higher torque to be achieved than with conventional internal combustion engines. This is because as the piston starts a power stroke, it is at maximum mechanical advantage with respect to the cam lobe.

Turning now to more specific details of internal combustion engines according to the invention, as noted above such engines include at least one cylinder module. An engine with a single cylinder module is merely preferred and engines can have from two to six modules. In multi-module engines, a single shaft extends throughout all modules, either as a unitary member or as interconnected shaft portions. Similarly, the cylinder blocks of multi-module engines can be integral with each other or separate.

A cylinder module typically has a single pair of cylinders. However, engines according to the invention can also have two pairs of cylinders per module. In cylinder modules having two pairs of cylinders, the pairs are typically disposed at 90° to each other.

With regard to the multilobate cams of engines according to the invention, a trilobate cam is preferred. This allows for six ignition cycles per cam revolution in a two-stroke engine. However, engines can also be configured with cams having five, seven, nine or more lobes per cam.

A lobe of a cam can be asymmetric to control piston speed at a particular stage of a cycle, such as to increase the dwell of a piston at TDC or at bottom-dead-center (BDC). It will be appreciated by those of skill in the art that an extended dwell at TDC improves combustion while an extended dwell at BDC allows better scavenging. Control of piston speed through lobe profile also allows control of piston acceleration and torque application. In particular, this allows for greater torque to be obtained immediately after TDC than is possible with a conventional reciprocating piston engine. Further control features provided by a variable piston rate include control of port opening speed compared with closing speed and control of compression rate with respect to combustion rate.

The first multilobate cam can be fixed to the shaft by any manner known in the art. Attentively, the shaft and first multilobate cam can be fabricated as a unitary member.

The differential gearing which allows counter rotation of the first and second multilobate cams, also times cam counter rotation. The manner of differentially gearing the cams can be by any manner known in the art. For example, bevel gears can be provided on opposed faces of the first and second multilobate cams with at least one bevelled pinion gear therebetween. Preferably, two diametrically opposed pinions are provided. A support member, in which the shaft is free to rotate, is advantageously provided for supporting pinions.

The rigid interconnection of pistons typically comprises at least two rods therebetween fixed to the undersides of pistons adjacent the periphery thereof. Preferably, four rods are used, equally spaced about the periphery of a piston. Guide sleeves are provided in a cylinder module for rods interconnecting pistons. Guide sleeves are typically configured to allow for lateral movement of rods on piston expansion and contraction.

Contact between pistons and the camming surfaces of cams is in a manner which minimizes vibration and frictional losses. Advantageously, a roller bearing is provided on the underside of a piston for contacting each camming surface.

It will be appreciated that the interconnection of pistons comprising a pair of opposed pistons allows control over clearance between the contact area of a piston—be it a roller bearing, a slide, or the like—and the camming surface of a cam. Furthermore, this manner of contact does not require grooves or the like in sides of cams to receive a conventional connecting rod as is the case with some engines of similar design. This feature of engines of similar design on overrun leads to wear and excessive noise, which disadvantages are substantially avoided in the present invention.

Engines according to the present invention can be two-stroke or four-stroke. In the former case, the combustible fuel mixture is typically supplied in conjunction with supercharging. However, any form of fuel and air supply can be used in conjunction with a four-stroke engine.

Cylinder modules according to the invention can also serve as air or gas compressors.

Other aspects of engines according to the invention are in accordance with what is generally known in the art. However, it will be appreciated that only a low pressure oil feed to the differential gearing of the multilobate cams is required, thus reducing the taxing of horsepower by the oil pump. Furthermore, other engine components, including pistons, can be splashfed oil. In this regard, it should be noted that oil splashed on to pistons by centrifugal force also serves to cool pistons.

Advantages of engines according to the invention include the following:

- engines are compact in design with fewer moving parts;
- engines can be run in either direction if multilobate cams with symmetrical lobes are employed;
- engines are lighter than conventional reciprocating-type engines;
- engines are more easily manufactured and assembled than conventional engines;
- the extended piston dwell possible because of engine design allows a lower than normal compression ratio to be used; and
- reciprocating components such as piston-crank shaft connecting rods are eliminated.

Further advantages of engines according to the invention because of the multilobate cams employed are that cams can be more easily manufactured than crankshafts, cams don't require extra balance weights, and, cams double as a flywheel therefore providing better momentum.

Having broadly described the invention, specific embodiments will now be exemplified with reference to the accompanying drawings, briefly described hereafter.

Like items in figures are identically numbered.

BEST MODE FOR CARRYING OUT THE INVENTION

Figure 1:
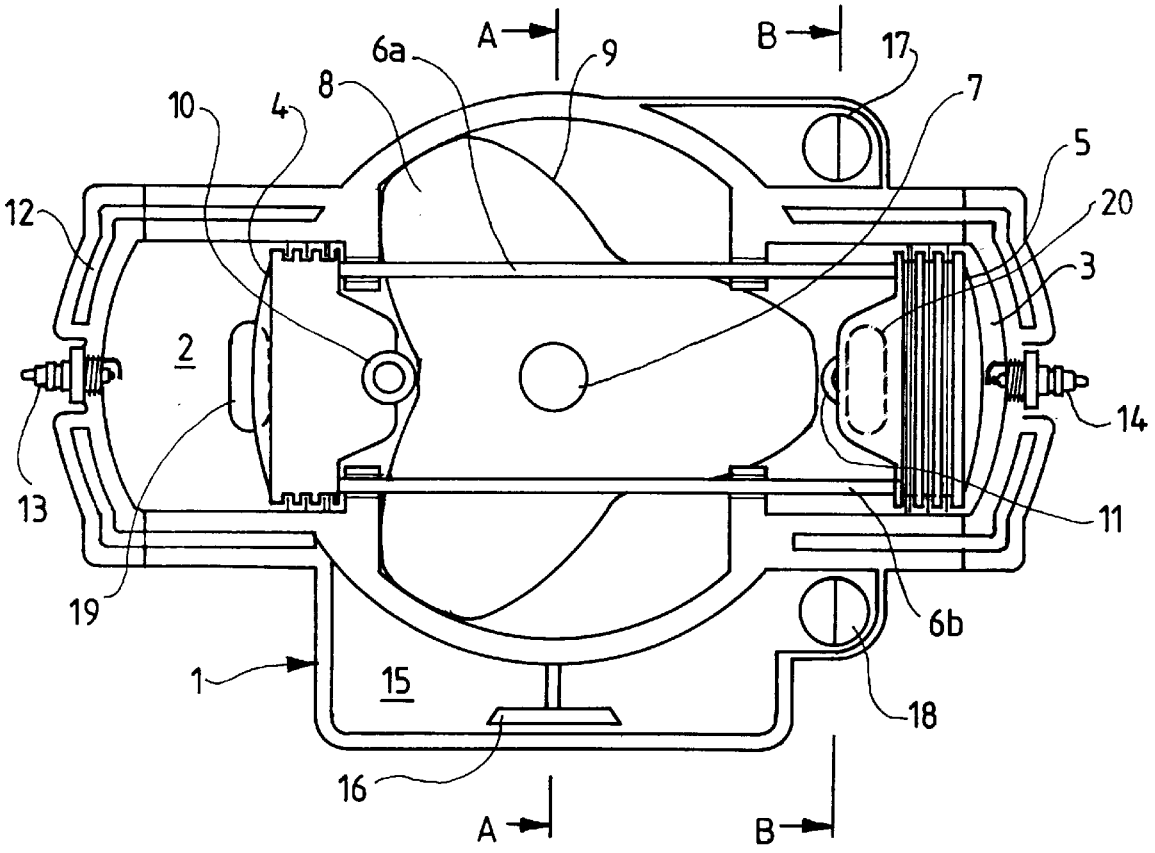
FIG. 1 is a cross-sectional view of a two-stroke engine comprising a single cylinder module with the cross-section being along the axis of the cylinders and transverse with respect to the engine shaft.

With reference to FIG. 1, there is shown two-stroke engine 1 comprising a single cylinder module having a single pair of cylinders made up of cylinders 2 and 3. Cylinders 2 and 3 have pistons 4 and 5 therein which are interconnected by four rods, two of which can be seen at 6*a* and 6*b*.

Engine 1 also includes a central shaft, the axis of which is indicated at 7, with which trilobate cams 8 and 9 are associated. Cam 9 is in fact co-incident with cam 8 in the view shown in the figure since pistons are at TDC or BDC. Pistons 4 and 5 contact cams 8 and 9 via roller bearings, the positions of which are generally indicated at 10 and 11.

Other features of engine 1 include water jacket 12, spark plugs 13 and 14, oil sump 15, oil pump pickup 16, and balance shafts 17 and 18. The location of inlet ports are indicated at 19 and 20 which also corresponds to the position of exhaust ports.

Figure 2:
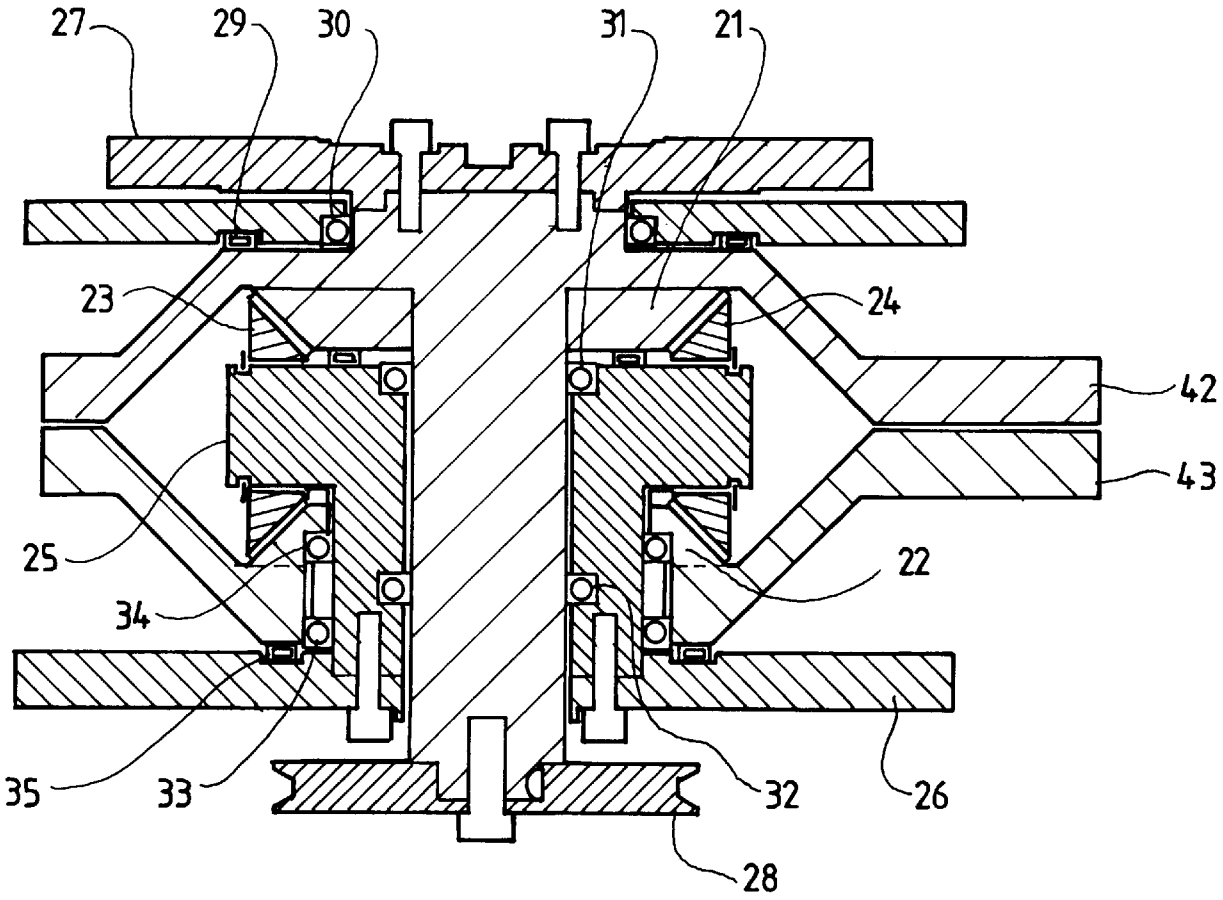
FIG. 2 is a partial cross-sectional view at A—A of FIG. 1.

Turning now to FIG. 2, cams 8 and 9 are shown in greater detail along with shaft 7 and differential gearing which will shortly be described. The cross-section shown in FIG. 2 is rotated 90° in respect of FIG. 1 and the cam lobes are in slightly different positions to those shown in FIG. 1.

The differential, or timing, gearing comprises bevel gear 21 on first cam 8, bevel gear 22 on second cam 9, and pinion gears 23 and 24. Pinion gears 23 and 24 are supported by gear support 25 which is secured to shaft housing 26. Shaft housing 26, it will be appreciated, is part of the cylinder module. Also shown in FIG. 2 are flywheel 27, pulley 28 and bearings 29 to 35.

First cam 8 is essentially an integral part of shaft 7. Second cam 9 can, however, counter rotate with respect to cam 8 but is timed to the rotation of cam 8 by the differential gearing.

Figure 3:
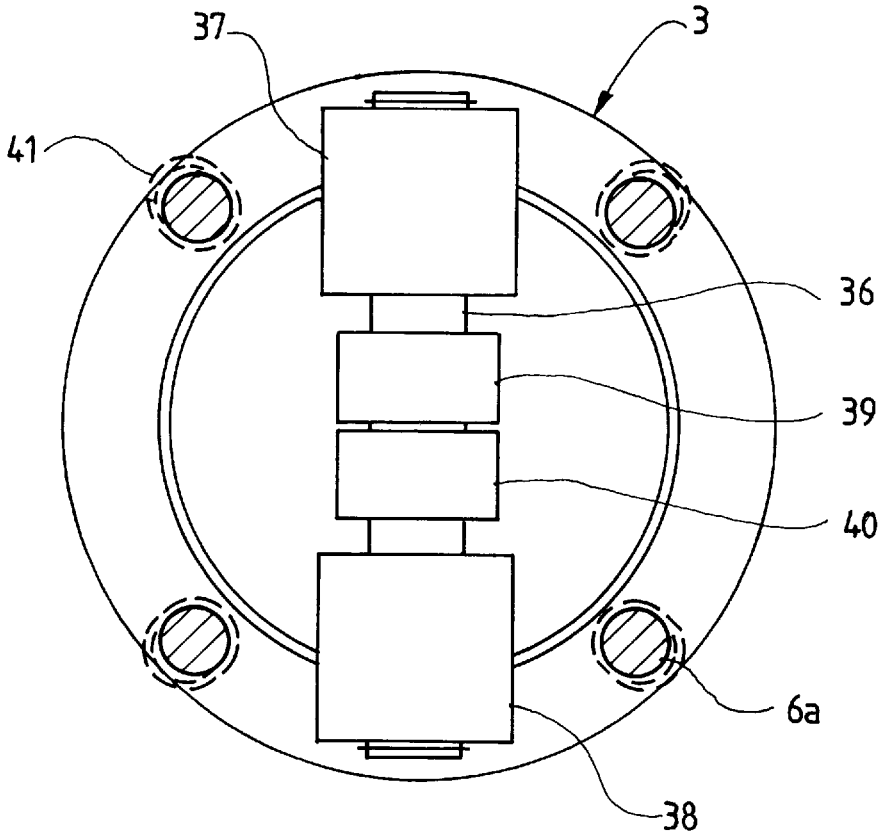
FIG. 3 is a partial cross-sectional view at B—B of FIG. 1 showing detail of the underside of a piston.

FIG. 3 shows the underside of piston 3 of FIG. 1 to provide detail of the roller bearings. In FIG. 3, piston 3 can be seen plus shaft 36 extending between bosses 37 and 38. Roller bearings 39 and 40 are carried by shaft 36, which correspond to the roller bearings as generally indicated at 10 and 11 of FIG. 1.

Interconnecting rods can also be seen in cross-section in FIG. 3, one of which is indicated at 4*a*. Sleeves through which interconnecting rods pass can be seen, one of which is indicated at 41.

Although FIG. 3 is at a slightly larger scale than FIG. 2, it can be appreciated that roller bearings 39 and 40 can contact camming surfaces 42 and 43 of cams 8 and 9 of FIG. 2 during engine operation.

The operation of engine 1 can be appreciated from FIG. 1. Movement of piston 4 and 5 from left to right on a power stroke in cylinder 2 causes rotation of cams 8 and 9 via contact therewith through roller bearing 10. A "scissor action" in effect occurs. Rotation of cam 8 effects rotation of shaft 7 while counter-rotating cam 9 also contributes to the rotation of shaft 7 by way of the differential gearing (see FIG. 2).

Because of the scissor action, greater torque is obtained on a power stroke than is possible with a conventional engine. Indeed, the stroke/piston diameter relationship depicted in FIG. 1 can tend to a significantly over-square configuration while still providing adequate torque.

Another feature of engines according to the invention revealed by FIG. 1 is that the equivalent of the crankcase of a conventional engine is sealed with respect to cylinders, unlike conventional two-stroke engines. This allows a non-oiled fuel to be used, thus reducing engine emission components.

Figure 4:
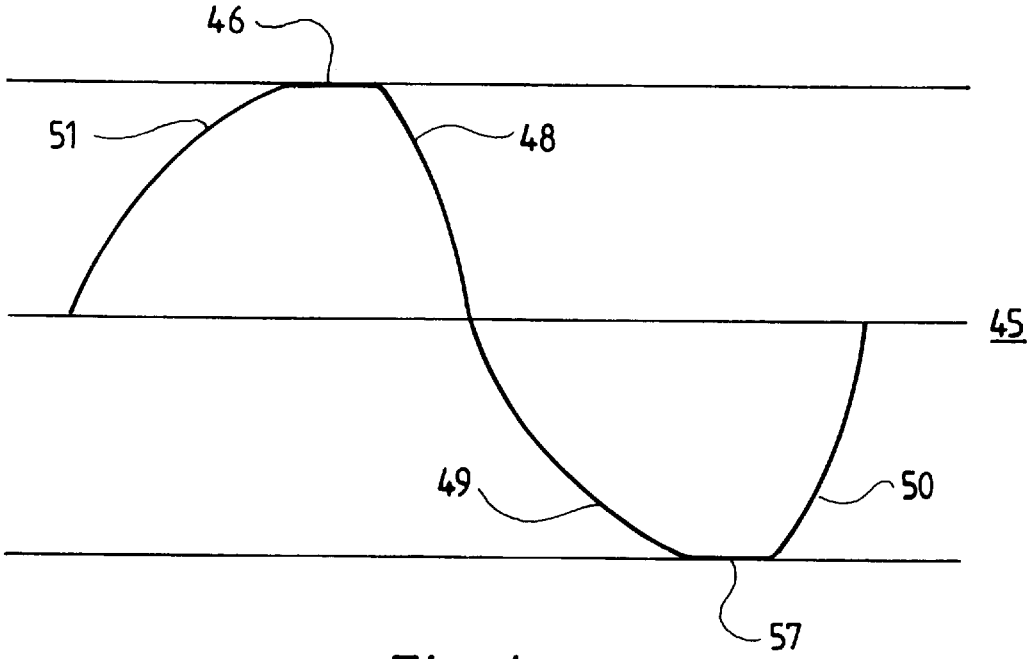
FIG. 4 is a graph depicting the position of a specific point on a piston during traversal of a single asymmetric cam lobe.

The control of piston speed and dwell at TDC and BDC using an asymmetric cam lobe is depicted in FIG. 4. FIG. 4 is a plot of a specific point on a piston as the piston oscillates between mid-point 45, TDC 46 and BDC 47. Because of an asymmetric cam lobe, the speed of the piston can be controlled. Firstly, it can be seen that the piston resides at TDC 46 for an extended period of time. Rapid piston acceleration at 48 provides higher torque on the combustion cycle while a slower piston speed at 49 at the end of the combustion cycle allows better port control. On the other hand, a faster piston speed at the start of the compression cycle 50 allows faster port closure for better fuel economy while a slow piston speed at the end 51 of that cycle gives better mechanical advantage.

Figure 5:
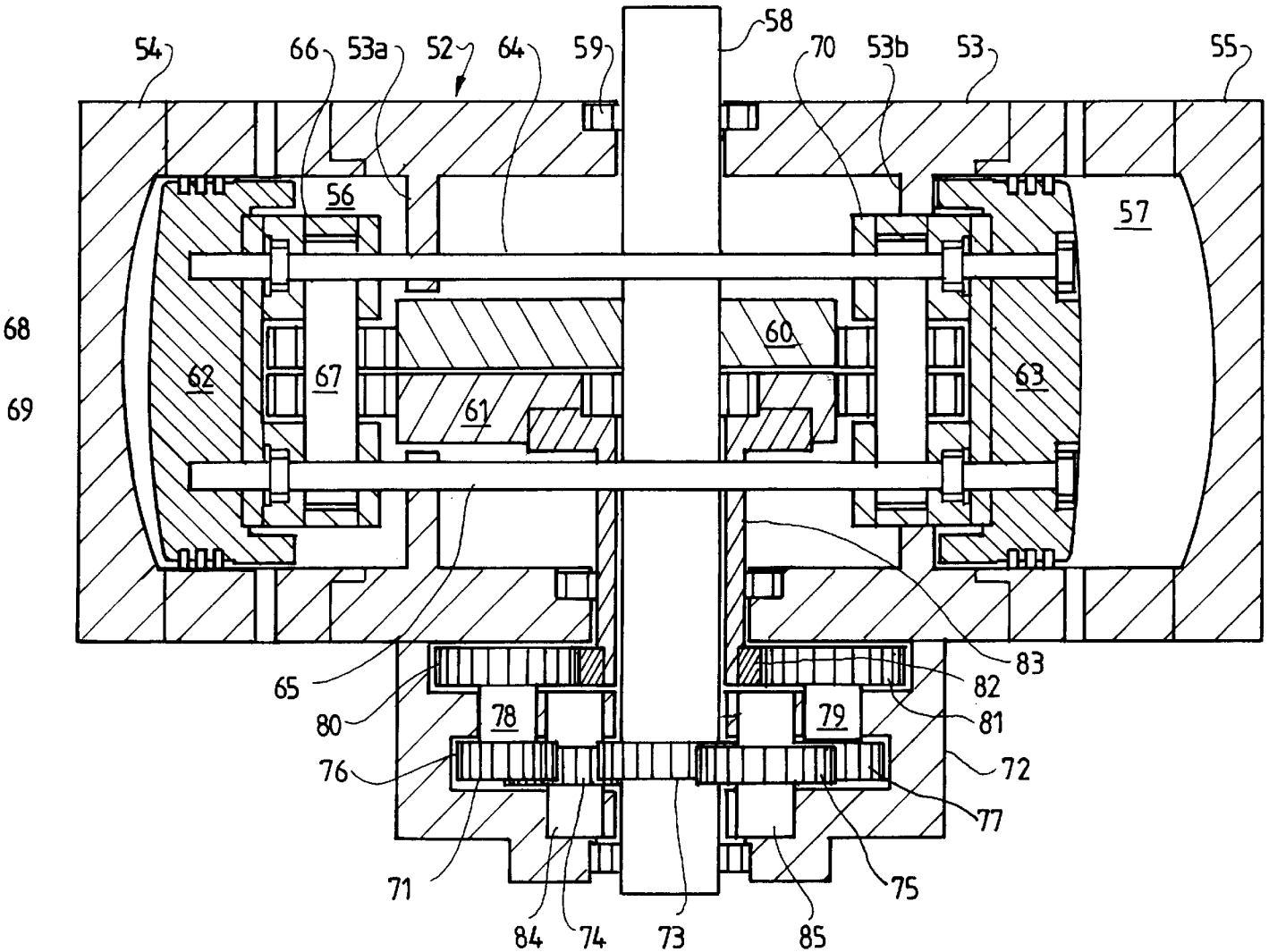
FIG. 5 is a partial cross-sectional view of another two-stroke engine comprising a single cylinder module with the cross-section being in the plane of the central shaft of the engine.

Turning to FIG. 5, there is shown another two stroke engine having a single cylinder module. The engine is shown in partial cross-section. In effect, half of the engine block has been removed to reveal internal detail of the engine. The cross-section is in a plane coincident with the axis of the central shaft of the engine (see below). The engine block has thus been split at its midline. However, some engine components are also shown in cross-section such as pistons 62 and 63, bearing bosses 66 and 70, trilobate cams 60 and 61, and a sleeve 83 associated with cam 61. All of these items will be discussed below.

Engine 52 of FIG. 5 comprises block 53, cylinder heads 54 and 55, and cylinders 56 and 57. A spark plug is included in each cylinder head but has been omitted from the drawing for clarity. Shaft 58 can rotate within block 53 and is supported by roller bearings, one of which is indicated at 59. Shaft 58 has a first trilobate cam 60 fixed thereto, which cam lies adjacent a counter rotating trilobate cam 61. Engine 52 includes a pair of rigidly interlinked pistons, 62 in cylinder 56 and 63 in cylinder 57. Pistons 62 and 63 are linked by four connecting rods, two of which are indicated at 64 and 65. (Connecting rods 64 and 65 are in a different plane to the remainder of the cross-section of the drawing. Similarly, the points of contact of the connecting rods and pistons 62 and 63 are not in the same plane as the remainder of the cross-section. The relationship between connecting rods and pistons is substantially the same as for the engine shown in FIGS. 1 to 3.) A web 53*a* extends internally of block 53, which web includes apertures through which the connecting rods pass. This web retains the connecting rods, and hence the pistons, in alignment with the axis of the cylinder module.

Roller bearings are interposed between the undersides of pistons and the camming surfaces of the trilobate cams. Referring to piston 62, there is mounted on the underside of the piston a bearing boss 66 which holds shaft 67 for roller bearings 68 and 69. Bearing 68 contacts cam 60 while bearing 69 contacts cam 61. It will be appreciated that piston 63 includes an identical bearing boss 70 with shaft and bearings. It can also be appreciated from bearing boss 70 that web 53*b* has an appropriate opening to allow passage of the bearing boss. Web 53*a* has a similar opening but the portion of the web shown in the drawing is in the same plane as connecting rods 64 and 65.

Counter rotation of cam 61 with respect to cam 60 is effected by a differential gear train 71 mounted externally of the engine block. A housing 72 is provided for holding, and covering, gear train components. In FIG. 5, housing 72 is in cross-section while gear train 71 and shaft 58 are not in cross section.

Gear train 71 comprises a sun gear 73 on shaft 58. Sun gear 73 contacts drive gears 74 and 75 which in turn contact planetary gears 76 and 77. Planetary gears 76 and 77 are connected via shafts 78 and 79 to a second set of planetary gears 80 and 81, which intermesh with a sun gear 82 on sleeve 83. Sleeve 83 is coaxial with respect to shaft 58 and the distal end of the sleeve is fixed to cam 61. Drive gears 74 and 75 are mounted on shafts 84 and 85, which shafts are supported by bearings in housing 72.

Figure 6:
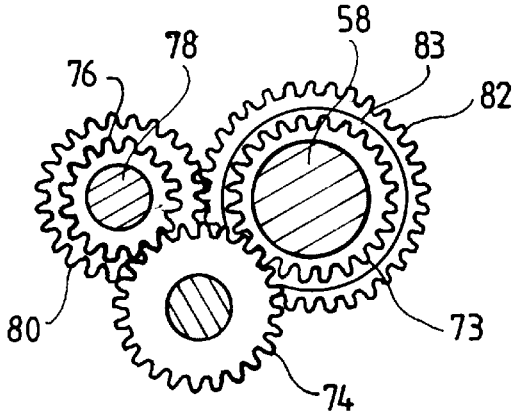
FIG. 6 is an end view of one of the gear trains of the engine depicted in FIG. 5.

Portion of gear train 71 is shown in FIG. 6. FIG. 6 is an end view of shaft 58 when viewed from the bottom of the FIG. 5 drawing.

In FIG. 6, sun gear 73 can be seen about shaft 58. Drive gear 74 is shown in contact with planetary gear 76 on shaft 78. The figure also shows second planetary gear 80 in contact with sun gear 82 on sleeve 83.

It can be appreciated from FIG. 6 that clockwise rotation, for example, of shaft 58 and sun gear 73 will impact a counter-clockwise rotation on sun gear 82 and sleeve 83 via drive gear 74 and planetary gears 76 and 80. Hence, cams 60 and 61 can counter rotate.

Other features of the engine shown in FIG. 5, and the operating principle of the engine, are the same as the engine shown in FIGS. 1 and 2. Specifically, downward thrust of a piston imparts a scissor-like action on the cams which can counter rotate by virtue of the differental gear train.

It will be appreciated that while the engine depicted in FIG. 5 uses plain gears in the differential gear train, a bevelled gear train could also be employed. Similarly, plain gears can be used in the differential gearing arrangement shown in the FIGS. 1 and 2 engine.

In the engines exemplified in FIGS. 1 to 3, and 5, the axes of the roller bearings which contact the camming surfaces of the trilobate cams are aligned. To further improve torque characteristics, axes of roller bearings can be offset.

Figure 7:
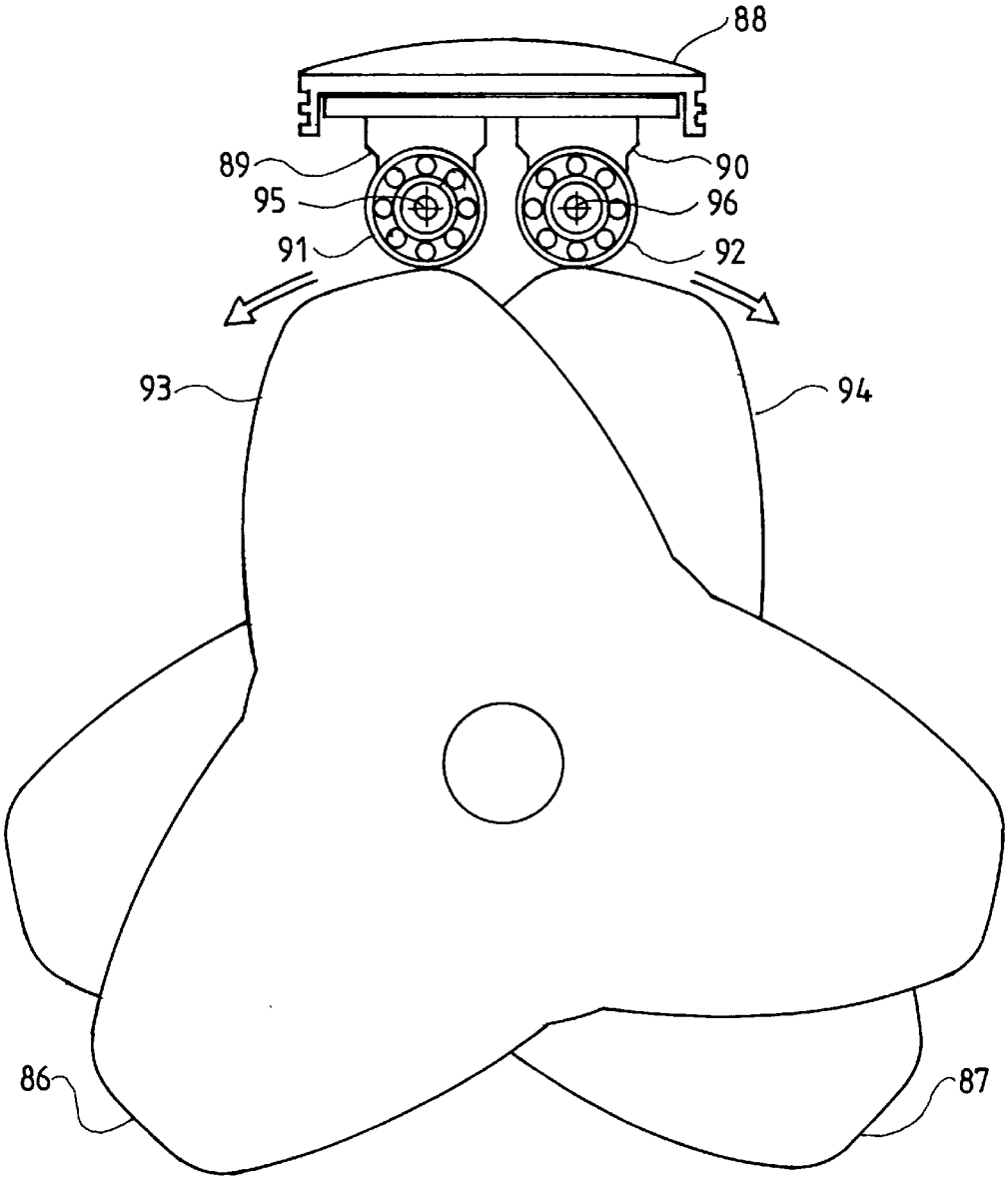
FIG. 7 is a schematic view of portion of an engine showing a piston in contact with counter rotating trilobate cams.

An engine with offset cam contacting bearings is shown schematically in FIG. 7. In this figure, which is a view along the central shaft of an engine, cam 86, counter rotating cam 87, and piston 88 are shown. Piston 88 includes bearing bosses 89 and 90 which carry roller bearings 91 and 92, which bearings are shown in contact with a lobe 93 and 94, respectively, of the trilobate cams 86 and 87.

It can be appreciated from FIG. 7 that the axes 95 and 96 of bearings 91 and 92 are offset from each other and from the piston axis. Having the bearings spaced apart from the piston axis increases torque by increasing mechanical advantage.

Figure 8:
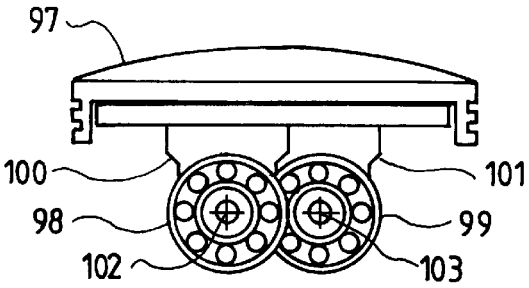
FIG. 8 is detail of a piston having offset cam-contacting bearings.

Detail of another piston with offset bearings on the underside thereof is given in FIG. 8. Piston 97 is shown with bearings 98 and 99 carried by housings 100 and 101 on the underside of the piston. It can be seen here that the axes 102 and 103 of bearings 98 and 99 are offset but not to the degree of offset of the FIG. 7 bearings. It will be appreciated that the greater separation of the bearings as shown in FIG. 7 results in increased torque.

While the foregoing description of particular embodiments applies to two-stroke engines, it will be appreciated that the general principles apply to two and four-stroke engines. It will be further appreciated that many changes and modifications can be made to the engines as exemplified without departing from the broad ambit and scope of the invention.

I claim:

1. An internal combustion engine comprising at least one cylinder module, said cylinder module comprising:

a shaft having a first multilobate cam axially fixed to said shaft and an adjacent second multilobate cam differentially geared to said first multilobate cam for axial counter rotation about said shaft;

at least one pair of cylinders, the cylinders of each pair are diametrically opposed with respect to said shaft with said multilobate cams interposed therebetween; and a piston in each said cylinder, which pistons of a pair of cylinders are rigidly interconnected;

wherein, said multilobate cams each comprise 3+n lobes where n is zero or an even-numbered integer;

and wherein, reciprocating motion of said pistons in said cylinders imparts rotary motion to said shaft via contact between said pistons and the camming surfaces of said multilobate cams.

2. Engine according to claim 1 comprising from 2 to 6 cylinder modules.

3. Engine according to claim 1 comprising two pairs of cylinders per cylinder module.

4. Engine according to claim 3, wherein said pairs of cylinders are at 90° to each other.

5. Engine according to claim 1, wherein said cams are each trilobate.

6. Engine according to claim 1, wherein each lobe of a said cam is asymmetric.

7. Engine according to claim 1, wherein said rigid interconnection of pistons comprises four rods extending between a pair of pistons with said rods equally spaced about the periphery of a piston.

8. Engine according to claim 7, wherein guide sleeves are provided for said rods.

9. Engine according to claim 1, wherein said differential gearing is mounted internally of said engine and in conjunction with said counter rotating cams.

10. Engine according to claim 1, wherein said differential gearing is mounted externally of said engine.

11. Engine according to claim 1 which is a two-stroke engine.

12. Engine according to claim 1, wherein contact between said pistons and the camming surfaces of said multilobate cams is via roller bearings.

13. Engine according to claim 12, wherein said roller bearings have a common axis.

14. Engine according to claim 12, wherein axes of said roller bearings are offset with respect to each other and said piston axis.

* * * * *